US012703537B2

(12) United States Patent
Srichai

(10) Patent No.: US 12,703,537 B2
(45) Date of Patent: Aug. 11, 2026

(54) SHIPPING CONTAINERS

(71) Applicant: Goodpack IBC (Singapore) Pte. Ltd., Singapore (SG)

(72) Inventor: Uthai Srichai, Bangkok (TH)

(73) Assignee: Goodpack IBC (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 18/892,087

(22) Filed: Sep. 20, 2024

(65) Prior Publication Data

US 2025/0011035 A1 Jan. 9, 2025

Related U.S. Application Data

(63) Continuation of application No. 17/611,055, filed as application No. PCT/IB2020/000378 on May 14, 2020, now Pat. No. 12,122,555.

(Continued)

(51) Int. Cl.
*B65D 19/12* (2006.01)
*B65D 77/06* (2006.01)

(52) U.S. Cl.
CPC ..... *B65D 19/12* (2013.01); *B65D 77/061* (2013.01); *B65D 2203/06* (2013.01); *B65D 2203/10* (2013.01); *B65D 2519/00059* (2013.01); *B65D 2519/00273* (2013.01); *B65D 2519/00293* (2013.01); *B65D 2519/00328* (2013.01); *B65D 2519/00562* (2013.01);

(Continued)

(58) Field of Classification Search
CPC ..... B65D 19/12; B65D 19/08; B65D 19/06; B65D 19/16; B65D 19/18; B65D 19/02; B65D 77/061; B65D 77/06; B65D 77/062; B65D 77/064; B65D 77/065; B65D 77/067; B65D 77/068
See application file for complete search history.

(56) References Cited

U.S. PATENT DOCUMENTS 5,056,667 A 10/1991 Coogan
5,242,255 A 9/1993 Gleffe (Continued)

FOREIGN PATENT DOCUMENTS

BR 112013000883 A2 5/2016
CL 200000636 U1 7/2001

(Continued)

OTHER PUBLICATIONS

European Patent Office, Communication Pursuant to Rule 164(1) EPC, Partial Supplementary European Search Report dated Oct. 31, 2022 for European Patent Application No. 20766176.0, 13 pages.

(Continued)

*Primary Examiner* — Javier A Pagan
(74) *Attorney, Agent, or Firm* — Fitch, Even, Tabin & Flannery, LLC

(57) ABSTRACT

Described herein are collapsible containers for transportation of cargo, and methods of using them. The containers may include textured bottom surfaces to facilitate positive engagement with a conveyor. In some embodiments, the containers include secure locking mechanisms that prevent inadvertent unlocking while also permitting one-handed operation. In some embodiments, the containers include adapters to facilitate discharge of liquid cargo.

14 Claims, 6 Drawing Sheets

Related U.S. Application Data

(60) Provisional application No. 62/849,559, filed on May 17, 2019.

(52) U.S. Cl.
CPC ..... *B65D 2519/00611* (2013.01); *B65D 2519/00711* (2013.01); *B65D 2519/00805* (2013.01); *B65D 2519/00835* (2013.01); *B65D 2519/00975* (2013.01)

(56) References Cited

U.S. PATENT DOCUMENTS

| | | | |
|---|---|---|---|
| 5,253,763 | A | 10/1993 | Kirkley |
| 5,269,414 | A | 12/1993 | D'Hollander |
| 5,415,311 | A | 5/1995 | Coogan |
| 5,509,257 | A | 4/1996 | Tagliaferri |
| 5,531,661 | A | 7/1996 | Moncrief |
| 5,564,599 | A | 10/1996 | Barber |
| 5,711,444 | A | 1/1998 | Meacham |
| 6,347,718 | B1 | 2/2002 | Karpisek |
| 6,955,273 | B2 | 10/2005 | Hartwall |
| 7,066,332 | B2 | 6/2006 | Kobayashi |
| 7,216,592 | B2 | 5/2007 | Krech |
| 7,281,637 | B2 | 10/2007 | Hadar |
| 7,350,662 | B2 | 4/2008 | Arnold |
| 7,819,269 | B2 | 10/2010 | Perkins |
| 8,228,201 | B2 | 7/2012 | Kennedy |
| 8,413,831 | B2 | 4/2013 | Nolan |
| 8,573,427 | B2 | 11/2013 | Lam |
| 8,844,753 | B2 | 9/2014 | Starnes |
| 8,955,709 | B2 | 2/2015 | Lorenz |
| 9,016,474 | B2 | 4/2015 | Ritzberger |
| 9,802,754 | B2 | 10/2017 | Navalon Simon |
| 10,065,763 | B2 | 9/2018 | Wilcox |
| RE47,210 | E | 1/2019 | Lam |
| 10,577,174 | B2 | 3/2020 | Fenneman |
| 11,021,320 | B2 | 6/2021 | Lv |
| 11,591,146 | B2 * | 2/2023 | Jian ..... B65D 19/06 |
| 12,122,555 | B2 * | 10/2024 | Srichai ..... B65D 77/061 |
| 2002/0070215 | A1 | 6/2002 | Walsh |
| 2004/0026296 | A1 | 2/2004 | Nesting |
| 2004/0059035 | A1 | 3/2004 | Krech |
| 2004/0149766 | A1 | 8/2004 | Karpisek |
| 2005/0000834 | A1 | 1/2005 | Clive-Smith |
| 2005/0139510 | A1 | 6/2005 | Zhang |
| 2005/0150892 | A1 | 7/2005 | Miller |
| 2005/0178770 | A1 | 8/2005 | Hase |
| 2005/0224494 | A1 | 10/2005 | Heinrichs |
| 2005/0230283 | A1 | 10/2005 | Kobayashi |
| 2006/0043090 | A1 | 3/2006 | Ferrini |
| 2006/0104755 | A1 | 5/2006 | Clive-Smith |
| 2006/0144838 | A1 | 7/2006 | Winn |
| 2006/0226143 | A1 | 10/2006 | Elstone, Sr. |
| 2007/0278223 | A1 | 12/2007 | Ficker |
| 2008/0011742 | A1 | 1/2008 | Bellehumeur |
| 2008/0029517 | A1 | 2/2008 | Briers |
| 2009/0272739 | A1 | 11/2009 | Fredrickson |
| 2010/0072199 | A1 | 3/2010 | Manuel |
| 2010/0147842 | A1 | 6/2010 | Reynard |
| 2011/0049823 | A1 | 3/2011 | Coats |
| 2012/0012492 | A1 | 1/2012 | Darden |
| 2013/0112685 | A1 | 5/2013 | Lam |
| 2014/0042157 | A1 | 2/2014 | Giesbers |
| 2016/0251153 | A1 | 9/2016 | Navalon Simon |
| 2016/0272364 | A1 | 9/2016 | Jian |
| 2017/0349198 | A1 | 12/2017 | Depadro |
| 2017/0349199 | A1 | 12/2017 | Septimio |
| 2017/0349324 | A1 | 12/2017 | Golanowski |
| 2020/0079582 | A1 | 3/2020 | Press |
| 2021/0261075 | A1 | 8/2021 | Pendergrass |
| 2022/0144540 | A1 | 5/2022 | Argentti |
| 2023/0322437 | A1 | 10/2023 | Phelps |
| 2023/0399142 | A1 | 12/2023 | Srichai |

FOREIGN PATENT DOCUMENTS

| | | | | |
|---|---|---|---|---|
| CL | 2007003534 | U1 | | 3/2009 |
| CN | 1589214 | A | | 3/2005 |
| CN | 201172503 | Y | | 12/2008 |
| CN | 201280262 | Y | | 7/2009 |
| CN | 201281057 | Y | | 7/2009 |
| CN | 101519146 | A | | 9/2009 |
| CN | 201808724 | U | | 4/2011 |
| CN | 201908924 | U | | 7/2011 |
| CN | 103158924 | B | | 6/2013 |
| CN | 203652327 | U | * | 6/2014 |
| CN | 105083698 | A | | 11/2015 |
| CN | 102837874 | B | | 8/2016 |
| CN | 107074400 | A | | 8/2017 |
| CN | 108341124 | A | | 7/2018 |
| CN | 207631661 | U | | 7/2018 |
| CN | 108657560 | A | | 10/2018 |
| CN | 208102617 | U | | 11/2018 |
| CN | 109229718 | A | | 1/2019 |
| CN | 208377317 | U | | 1/2019 |
| CN | 208485096 | U | | 2/2019 |
| CN | 208499327 | U | | 2/2019 |
| CN | 109533561 | A | | 3/2019 |
| CN | 110436014 | A | | 11/2019 |
| CN | 209634890 | U | | 11/2019 |
| CN | 110641849 | A | | 1/2020 |
| CN | 110641850 | A | | 1/2020 |
| CN | 110877780 | A | | 3/2020 |
| CN | 111155855 | A | | 5/2020 |
| CN | 111511663 | A | | 8/2020 |
| CN | 111846649 | A | | 10/2020 |
| CN | 112027293 | A | | 12/2020 |
| CN | 112124741 | A | | 12/2020 |
| CN | 112141485 | A | | 12/2020 |
| CN | 112141531 | A | | 12/2020 |
| CN | 212125891 | U | | 12/2020 |
| CN | 212176867 | U | | 12/2020 |
| CN | 112550970 | A | | 3/2021 |
| CN | 112572949 | A | | 3/2021 |
| CN | 212710519 | U | | 3/2021 |
| CN | 212767373 | U | | 3/2021 |
| CN | 102773618 | B8 | | 4/2021 |
| CN | 112830112 | A | | 5/2021 |
| CN | 112896827 | A | | 6/2021 |
| CN | 213706178 | U | | 7/2021 |
| CN | 113291648 | A | | 8/2021 |
| CN | 113291649 | A | | 8/2021 |
| CN | 214058247 | U | | 8/2021 |
| CN | 214190562 | U | | 9/2021 |
| CN | 214242101 | U | | 9/2021 |
| CN | 113501220 | A | | 10/2021 |
| CN | 214341424 | U | | 10/2021 |
| CN | 214453818 | U | | 10/2021 |
| CN | 109986255 | B | | 11/2021 |
| CN | 214608970 | U | | 11/2021 |
| CN | 214649733 | U | | 11/2021 |
| CN | 214825035 | U | | 11/2021 |
| CN | 214876350 | U | | 11/2021 |
| CN | 214876351 | U | | 11/2021 |
| CN | 214877271 | U | | 11/2021 |
| CN | 113751935 | A | | 12/2021 |
| CN | 113800079 | A | | 12/2021 |
| CN | 113800080 | A | | 12/2021 |
| CN | 113830393 | A | | 12/2021 |
| CN | 215044727 | U | | 12/2021 |
| CN | 215053960 | U | | 12/2021 |
| CN | 215156568 | U | | 12/2021 |
| CN | 215206473 | U | | 12/2021 |
| CN | 215206475 | U | | 12/2021 |
| CN | 215206546 | U | | 12/2021 |
| CN | 215206547 | U | | 12/2021 |
| CN | 215246236 | U | | 12/2021 |
| CN | 215246257 | U | | 12/2021 |
| CN | 215324662 | U | | 12/2021 |
| CN | 215362933 | U | | 12/2021 |
| CN | 113968400 | A | | 1/2022 |
| CN | 215400729 | U | | 1/2022 |
| CN | 215624175 | U | | 1/2022 |

(56) References Cited

FOREIGN PATENT DOCUMENTS

| | | | |
|---|---|---|---|
| CN | 215737787 | U | 2/2022 |
| CN | 215754314 | U | 2/2022 |
| CN | 215754342 | U | 2/2022 |
| CN | 105314294 | B | 3/2022 |
| CN | 114142137 | A | 3/2022 |
| CN | 114248993 | A | 3/2022 |
| CN | 215922843 | U | 3/2022 |
| CN | 215944818 | U | 3/2022 |
| CN | 216076045 | U | 3/2022 |
| CN | 216101731 | U | 3/2022 |
| CN | 216103278 | U | 3/2022 |
| CN | 216103904 | U | 3/2022 |
| CN | 216103927 | U | 3/2022 |
| CN | 111940971 | B | 4/2022 |
| CN | 114275388 | A | 4/2022 |
| CN | 114313648 | A | 4/2022 |
| CN | 216195453 | U | 4/2022 |
| CN | 216234098 | U | 4/2022 |
| CN | 216402569 | U | 4/2022 |
| CN | 216467949 | U | 5/2022 |
| CN | 216508449 | U | 5/2022 |
| CN | 216510641 | U | 5/2022 |
| CN | 216510680 | U | 5/2022 |
| CN | 216547258 | U | 5/2022 |
| CN | 216547259 | U | 5/2022 |
| CN | 216547260 | U | 5/2022 |
| CN | 216547816 | U | 5/2022 |
| CN | 216564988 | U | 5/2022 |
| CN | 216564989 | U | 5/2022 |
| CN | 216581582 | U | 5/2022 |
| CN | 216617010 | U | 5/2022 |
| CN | 216637570 | U | 5/2022 |
| CN | 114620360 | A | 6/2022 |
| CN | 216685793 | U | 6/2022 |
| CN | 216709987 | U | 6/2022 |
| CN | 216762522 | U | 6/2022 |
| CN | 216762560 | U | 6/2022 |
| CN | 104909082 | B | 7/2022 |
| CN | 111874474 | B | 7/2022 |
| CN | 112325554 | B | 7/2022 |
| CN | 216888281 | U | 7/2022 |
| CN | 216888324 | U | 7/2022 |
| CN | 216896768 | U | 7/2022 |
| CN | 216944041 | U | 7/2022 |
| CN | 216944538 | U | 7/2022 |
| CN | 216995856 | U | 7/2022 |
| CN | 216995867 | U | 7/2022 |
| CN | 216995916 | U | 7/2022 |
| CN | 217049967 | U | 7/2022 |
| CN | 217049989 | U | 7/2022 |
| CN | 111746958 | B | 8/2022 |
| CN | 114852538 | A | 8/2022 |
| CN | 114940316 | A | 8/2022 |
| CN | 217100212 | U | 8/2022 |
| CN | 217199536 | U | 8/2022 |
| CN | 217202317 | U | 8/2022 |
| CN | 113525601 | B | 9/2022 |
| CN | 115036617 | A | 9/2022 |
| CN | 115043063 | A | 9/2022 |
| CN | 115072125 | A | 9/2022 |
| CN | 115133157 | A | 9/2022 |
| CN | 217372322 | U | 9/2022 |
| CN | 217375300 | U | 9/2022 |
| CN | 217436460 | U | 9/2022 |
| CN | 217436624 | U | 9/2022 |
| CN | 217436670 | U | 9/2022 |
| CN | 217436671 | U | 9/2022 |
| CN | 217444530 | U | 9/2022 |
| CN | 217478103 | U | 9/2022 |
| CN | 217478111 | U | 9/2022 |
| CN | 217492760 | U | 9/2022 |
| CN | 217503325 | U | 9/2022 |
| CN | 112027293 | B | 10/2022 |
| CN | 115199936 | A | 10/2022 |
| CN | 115240760 | A | 10/2022 |
| CN | 217599379 | U | 10/2022 |
| CN | 217599384 | U | 10/2022 |
| CN | 217599385 | U | 10/2022 |
| CN | 217599386 | U | 10/2022 |
| CN | 217624722 | U | 10/2022 |
| CN | 217650043 | U | 10/2022 |
| CN | 217673884 | U | 10/2022 |
| CN | 217673885 | U | 10/2022 |
| CN | 114084536 | B | 11/2022 |
| CN | 115298114 | A | 11/2022 |
| CN | 115303657 | A | 11/2022 |
| CN | 115321038 | A | 11/2022 |
| CN | 115367315 | A | 11/2022 |
| CN | 115410740 | A | 11/2022 |
| CN | 115411428 | A | 11/2022 |
| CN | 217731474 | U | 11/2022 |
| CN | 217755038 | U | 11/2022 |
| CN | 217788757 | U | 11/2022 |
| CN | 217806526 | U | 11/2022 |
| CN | 217918934 | U | 11/2022 |
| CN | 217919500 | U | 11/2022 |
| CN | 217919501 | U | 11/2022 |
| CN | 217919512 | U | 11/2022 |
| CN | 217919543 | U | 11/2022 |
| CN | 217919544 | U | 11/2022 |
| CN | 111619970 | B | 12/2022 |
| CN | 113460518 | B | 12/2022 |
| CN | 217945900 | U | 12/2022 |
| CN | 217945901 | U | 12/2022 |
| CN | 217946320 | U | 12/2022 |
| CN | 217970359 | U | 12/2022 |
| CN | 217999101 | U | 12/2022 |
| CN | 115557119 | A | 1/2023 |
| CN | 115593752 | A | 1/2023 |
| CN | 115610307 | A | 1/2023 |
| CN | 218199402 | U | 1/2023 |
| CN | 218229184 | U | 1/2023 |
| CN | 218229907 | U | 1/2023 |
| CN | 218344012 | U | 1/2023 |
| CN | 218368916 | U | 1/2023 |
| CN | 218390881 | U | 1/2023 |
| CN | 218401979 | U | 1/2023 |
| CN | 218401981 | U | 1/2023 |
| CN | 218401985 | U | 1/2023 |
| CN | 218401994 | U | 1/2023 |
| CN | 218405824 | U | 1/2023 |
| CN | 218406717 | U | 1/2023 |
| CN | 218406723 | U | 1/2023 |
| CN | 218406727 | U | 1/2023 |
| CN | 218409542 | U | 1/2023 |
| CN | 107235253 | B | 2/2023 |
| CN | 115703570 | A | 2/2023 |
| CN | 218513187 | U | 2/2023 |
| CN | 107226298 | B | 3/2023 |
| CN | 107237975 | B | 3/2023 |
| CN | 115725155 | A | 3/2023 |
| CN | 115817972 | A | 3/2023 |
| CN | 115818033 | A | 3/2023 |
| CN | 115818034 | A | 3/2023 |
| CN | 218559579 | U | 3/2023 |
| CN | 218559681 | U | 3/2023 |
| CN | 218704681 | U | 3/2023 |
| CN | 218704687 | U | 3/2023 |
| CN | 218705700 | U | 3/2023 |
| CN | 218752013 | U | 3/2023 |
| CN | 114249033 | B | 4/2023 |
| CN | 115892772 | A | 4/2023 |
| CN | 115892776 | A | 4/2023 |
| CN | 115946987 | A | 4/2023 |
| CN | 115953726 | A | 4/2023 |
| CN | 115958809 | A | 4/2023 |
| CN | 115973623 | A | 4/2023 |
| CN | 218807287 | U | 4/2023 |
| CN | 218859212 | U | 4/2023 |
| CN | 218876781 | U | 4/2023 |
| CN | 218887366 | U | 4/2023 |
| DE | 4429483 | A1 | 2/1996 |
| DE | 29703167 | U1 | 4/1997 |
| DE | G87152967 | U1 | 1/1998 |

(56) References Cited

FOREIGN PATENT DOCUMENTS

| | | | | |
|---|---|---|---|---|
| DE | 102009020599 | A1 | 11/2010 | |
| DE | 202018000701 | U1 | 2/2018 | |
| EP | 0321859 | A2 | 6/1989 | |
| EP | 1136389 | A2 | 9/2001 | |
| EP | 1375355 | A2 | 1/2004 | |
| EP | 1683727 | A1 | 7/2006 | |
| EP | 2192021 | A2 | 6/2010 | |
| EP | 2615041 | B1 | 3/2015 | |
| EP | 4065911 | B1 | 11/2023 | |
| JP | S51104837 | U | 8/1976 | |
| JP | H06199347 | A | 7/1994 | |
| JP | H07232789 | A | 9/1995 | |
| JP | H09012133 | A | 1/1997 | |
| JP | H10053222 | A | 2/1998 | |
| JP | H1080671 | A | 3/1998 | |
| JP | 2001278383 | A | 10/2001 | |
| JP | 2002308267 | A | 10/2002 | |
| JP | 2003237780 | A | 8/2003 | |
| JP | 2005081534 | A | 3/2005 | |
| JP | 2007161258 | A | 6/2007 | |
| JP | 3133715 | U | 7/2007 | |
| JP | 2008100698 | A | 5/2008 | |
| JP | 2016060532 | A | 4/2016 | |
| JP | 2019001526 | A | 1/2019 | |
| JP | 6859458 | B2 | 4/2021 | |
| KR | 20120006954 | U | 10/2012 | |
| KR | 200465521 | Y1 * | 2/2013 | ..... B65D 7/24 |
| KR | 101375806 | B1 | 3/2014 | |
| KR | 101641906 | B1 | 7/2016 | |
| KR | 20170102666 | A | 9/2017 | |
| KR | 101824568 | B1 | 3/2018 | |
| NL | 1013830 | C2 | 6/2001 | |
| TW | 201408550 | A | 3/2014 | |
| WO | 9813284 | A1 | 4/1998 | |
| WO | 0156898 | A1 | 8/2001 | |
| WO | 2007111618 | A1 | 10/2007 | |
| WO | 2007129986 | A1 | 11/2007 | |
| WO | 2017058767 | A1 | 4/2017 | |
| WO | 2022096928 | A1 | 5/2022 | |

OTHER PUBLICATIONS

European Patent Office, Extended European Search Report dated Oct. 4, 2023 for European Patent Application No. 20809120.7, 15 pages.

Patent Cooperation Treaty, International Search Report and Written Opinion of the International Searching Authority dated Jan. 5, 2022 for International Application No. PCT/IB2021/000622, 10 pages.

Patent Cooperation Treaty, International Search Report dated Mar. 3, 2022 for International Application No. PCT/IB2021/000764, 4 pages.

Patent Cooperation Treaty, International Search Report for International Application No. PCT/IB2020/000183 dated Jul. 17, 2020, 3 pages.

Patent Cooperation Treaty, International Search Report for International Application No. PCT/IB2020/000378 dated Sep. 1, 2020, 3 pages.

Patent Cooperation Treaty, Written Opinion of the International Searching Authority dated Mar. 3, 2022 for International Application No. PCT/IB2021/000764, 7 pages.

Patent Cooperation Treaty, Written Opinion of the International Searching Authority for International Application No. PCT/IB2020/000183 dated Jul. 17, 2020, 9 pages.

Patent Cooperation Treaty, Written Opinion of the International Searching Authority for International Application No. PCT/IB2020/000378 dated Sep. 1, 2020, 5 pages.

* cited by examiner

SHIPPING CONTAINERS

CROSS-REFERENCE TO RELATED APPLICATION

This application is a continuation of prior application Ser. No. 17/611,055, filed Nov. 12, 2021, which entered the U.S. National Phase from International Application Number PCT/IB2020/000378, filed May 14, 2020, which claims priority to U.S. Provisional Application No. 62/849,559, filed May 17, 2019, which are hereby fully incorporated by reference as if fully set forth herein.

FIELD

This application relates to containers, and more specifically to collapsible containers for transportation of cargo, and to methods of making and using them.

BACKGROUND

Reusable, stackable containers such as those disclosed in U.S. Pat. No. RE 47,210, which is incorporated by reference herein, can be useful for transporting various types of cargo, e.g., by rail, in overseas commerce, and in other contexts. Where a fleet of containers of this type is intended to include stacks of up to, e.g., four or five fully-loaded containers during shipping operations, it is desirable for each container in a fleet to be capable of supporting the weight of multiple fully loaded containers stacked above it. Other prior stackable containers are described in CN103158924B and CN201172503Y.

When a container is loaded with a liquid or other flowable material such as tomato paste, a flexible impermeable liner or bladder may be provided. Such liners have proven effective in containing flowable materials during transit, but discharging the liquid at the container's destination quickly and efficiently without leakage or spillage can sometimes be problematic. Discharge of fluids may involve extending a spout on the bladder through an opening in a side wall of the container. In some cases, the opening in the side wall may have rough edges that can damage the spout. There is a need for improvement in containers for transporting liquids and other flowable materials.

When a container is loaded with high specific gravity flowable materials or certain types of solid materials, the load may exert outward pressure on the sidewalls. One particular material that can apply significant outward pressure on the sidewalls is rubber, which in some cases can apply increasing outward pressure over time during transport. Significant inward pressure and impact loads may also be applied to the sidewalls by forklift tines and by other containers during handling. For example, when containers are shipped by rail, stopping and starting of railcars may result in adjacent containers contacting and exerting forces on one another. To provide the strength required to withstand such pressures as well as stacking loads and other loads associated with, e.g., handling by forklifts, many commercial shipping containers have a relatively heavy steel construction, and as a result their weight may be a significant percentage of their capacity. For example, a Goodpack MB5 intermediate bulk container that is capable of carrying a payload of about 1,650 kg. or 3,637 lbs. in commercial use may have a tare weight of about 280 to 300 lbs. There is a continuing interest in providing new and improved shipping containers that provide similar functionality to existing commercial containers but with decreased tare weight.

Goodpack MB5 containers include a removable front wall supported in a U-shaped frame that has an L-shaped cross section, with one flange extending generally parallel to the removable front wall, and one flange extending inward and perpendicular thereto for engagement with an adjacent side wall. These containers are capable of being readily modified to enable a double container to be assembled for use in shipping automobile transmissions and other items that are longer than a single container. This is accomplished by replacing the standard U-shaped frame with a modified U-shaped frame that has a T-shaped cross section, which has two flanges engaging respective sidewalls of the two containers that are joined. While a double container formed from two MB5 containers can be very useful, the bottom of the U-shaped frame can be problematic in some applications insofar as it protrudes upward about 2 in. and extends across the joint between the two containers in the form of a raised ridge or rim.

Collapsible shipping containers often include locking mechanisms to secure movable front, back and side walls. It is desirable that the locking mechanisms can be locked and unlocked quickly and easily to facilitate loading, unloading, assembly, and disassembly of the containers. In some cases, it may be possible for the locking mechanisms to be inadvertently opened by vibrations and/or other phenomena during shipping and handling. It is generally desirable for locking mechanisms to be secure and resistant to such inadvertent opening, but without the locking mechanisms adding unnecessarily to the cost or tare weight of the container, and without including unnecessarily complicated mechanism that can make locking or unlocking unnecessarily complicated or time consuming. It is generally undesirable for the locking members to include excessive numbers of small parts, such as small springs associated with latches or locks, that may potentially break or become separated from their associated containers, resulting in parts or fragments that might potentially fall into a payload. There is a need for improvement in locking mechanisms for collapsible shipping containers.

Collapsible shipping containers often include a bar code label, RFID tag, or other means to facilitate tracking by providing a unique, machine readable identifier for each container. In some cases, labels or tags can be difficult to access, e.g., for containers at the top of a five-high stack. Such labels and tags can also be subject to damage or wear due, e.g., to impacts with or abrasion by forklift tines, other containers. There is a need for improvement in this area as well.

SUMMARY

Described herein are collapsible containers that address one or more of the above-mentioned issues. Each container comprises a generally rectangular base with four walls extending upward therefrom, i.e., a front wall, a rear wall, and a pair of side walls. In some embodiments, a lid may extend generally horizontally between the upper edges of the walls to enclose the interior of the container. The containers are preferably compliant with applicable ASTM standards, e.g., drop test, road vibration and stack test standards. In some embodiments, the containers include the features of the containers described in the above-referenced U.S. Pat. No. RE 47,210, except to the extent that such features are inconsistent with those described and shown herein.

In some embodiments, each container includes lightweight, easy-to-use locking mechanisms adjacent opposite vertical edges of a front wall to facilitate securing and releasing a front wall when the container is in its erected position. In some embodiments, the locking mechanism includes a locking pin that is longitudinally movable between (1) a closed position in which it extends into an opening in an adjacent sidewall, and (2) an open position in which it does not extend into the opening. When locked, the pin can be prevented from sliding to open position by a handle that engages a stop. To open the locking mechanisms, the handle is lifted away from the container wall, thereby rotating the locking pin, and disengaging the handle from the stop.

In some embodiments, when this mechanism is in its locked position, a spring keeps the handle engaged with a retainer in a position of very stable mechanical equilibrium, which prevents the handle from being lifted away from the container wall. The retainer may by generally J-shaped as viewed in plan, such that the retainer has a first portion that extends outward from the front of the front wall, and a second portion that extends in a different direction, toward a nearby corner of the container. In some embodiments, the spring urges the pin and its handle away from the corner, i.e., toward the open position, thereby maintaining pressure on the handle to keep it in engagement with the retainer. To unlock the locking mechanism, the pin must be translated axially away from the open position by overcoming the spring force, then pulled away from the container wall. Unlocking can easily be accomplished with one hand, engaging only the handle. A stop or other means may be provided to maintain spacing between the handle and the adjacent wall surface to facilitate insertion of a digit between the handle and the adjacent wall surface to initiate unlocking.

In some embodiments, the containers are certified for transportation by rail, and useful for transportation of liquids such as tomato paste, with a bag, liner or bladder fitting within the container to hold the liquid cargo. In some embodiments, an adapter is provided at or near the bottom of one of the side walls to receive a discharge spout from the bag. The discharge spout may flexible. The adapter defines an opening through which the discharge spout may be pulled, and includes an interior locking structure that engages exterior structure on the spout to lock the spout in an extended discharge position. This facilitates discharge of liquid cargo by gravity, with the bag collapsing as the liquid cargo flows out of the bad through the discharge spout.

Each container may include an identification component comprising an RFID tag, bar code label, and/or other identifier in a recess or slot in the base. This positioning offers protection from damage due to contact between cargo units, and also offers some protection from contact with forklift tines or other potential sources of damage. The recess or slot may be generally rectangular, and may comprise a trapezoidal top surface that slopes down and in, a trapezoidal bottom surface that slopes up and in, and trapezoidal vertical side surfaces that are angled inward from an exterior front surface of the base.

DETAILED DESCRIPTION

Figure 1:
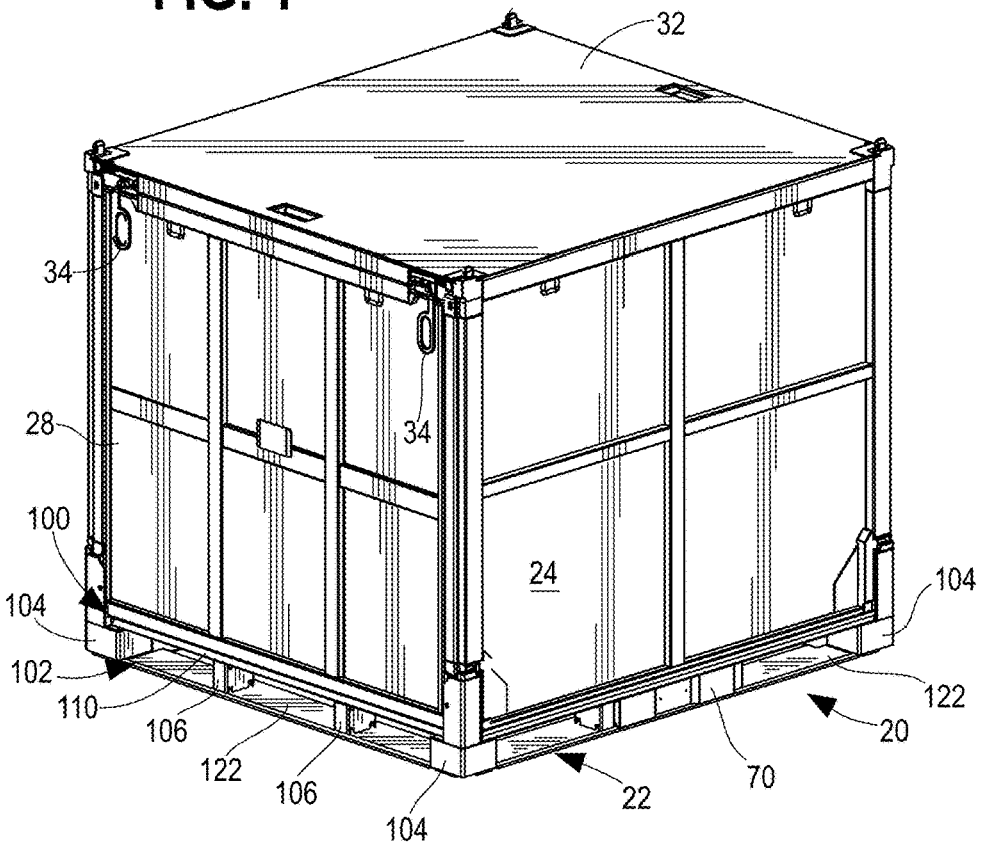
FIG. 1 is a perspective view of a first embodiment in an erected configuration.

FIGS. 1-7 illustrate a collapsible container 20 comprising a generally rectangular base 22 with four walls extending upward therefrom, i.e., front and rear walls 24, and a pair of side walls 28. A lid 32 may be supported on the upper edges of the walls to enclose the interior of the container.

The container 20 includes lightweight, easy-to-use locking mechanisms 34 adjacent opposite vertical edges of the front wall to facilitate securing and releasing the front wall when the container is in its erected position. Each of the illustrated locking mechanisms includes a locking pin 36 that is longitudinally movable between (1) a closed position, illustrated herein, in which it extends into an opening in an adjacent sidewall, and (2) an open position (not shown) in which the pin is retracted so that it does not extend into the opening, and the front wall may pivot relative to the adjacent sidewall. When locked, the pin is prevented from sliding to open position by a handle 38 that engages a retainer 40. To open the locking mechanisms, the handle is first displaced laterally toward the adjacent side wall, then lifted away from the adjacent exterior surface of the front wall, thereby rotating the locking pin, and disengaging the handle from the stop.

Figure 6:
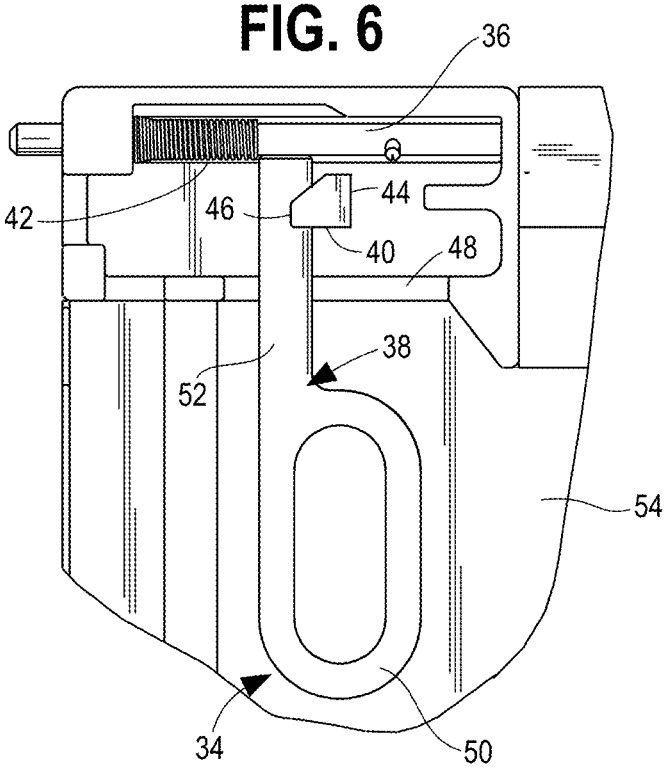
FIG. 6 is an elevational view of a latch mechanism.
Figure 7:
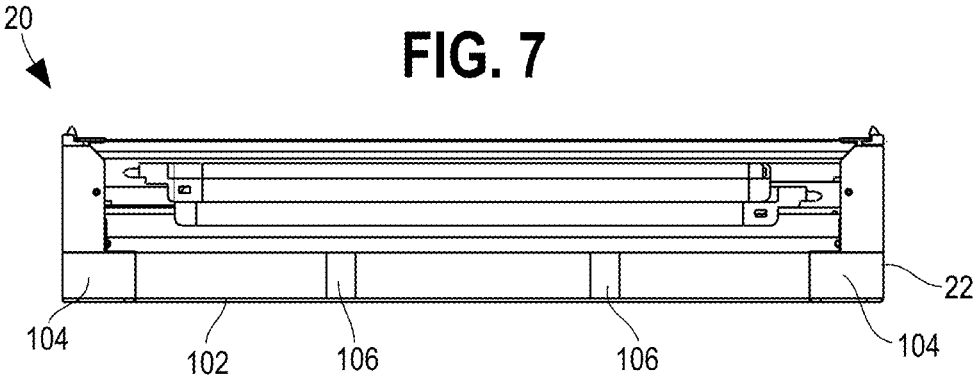
FIG. 7 is a front elevational view of the first embodiment in a collapsed configuration.

When this mechanism is in its locked position, a spring 42 keeps the handle 38 engaged with the retainer in a position of stable mechanical equilibrium, which prevents the handle from being lifted away from the front wall. The retainer may by generally J-shaped or L-shaped as viewed in plan, with a first portion 44 that extends outward from the front of the front wall, and a second portion 46 that extends transversely therefrom. The spring urges the pin and handle away from the adjacent side wall, i.e., toward the open position, thereby maintaining pressure on the handle to keep it in engagement with the retainer. To unlock the locking mechanism, the pin must be translated axially away from the open position by overcoming the spring force, then pivoted away from the front wall. Unlocking can easily be accomplished with one hand, engaging only the handle. As shown in FIG. 6, the handle may be generally "b" shaped, with a lower portion comprising a closed loop 50, and a vertical arm 52 extending upward therefrom to the locking pin 36. A horizontal ridge 48 on the front wall engages the arm 52 to maintain spacing between the lower portion 50 and the adjacent front wall surface 54, to facilitate insertion of a digit between the handle and the adjacent wall surface to initiate unlocking.

Figure 8:
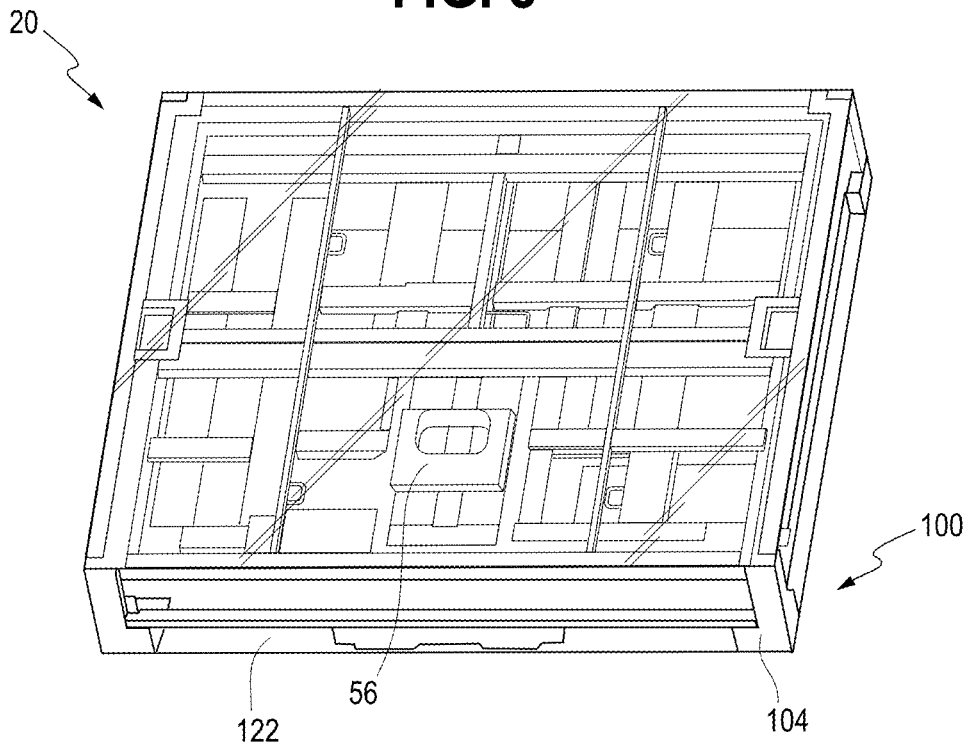
FIG. 8 is a perspective view of a second embodiment in a collapsed configuration.
Figure 9:
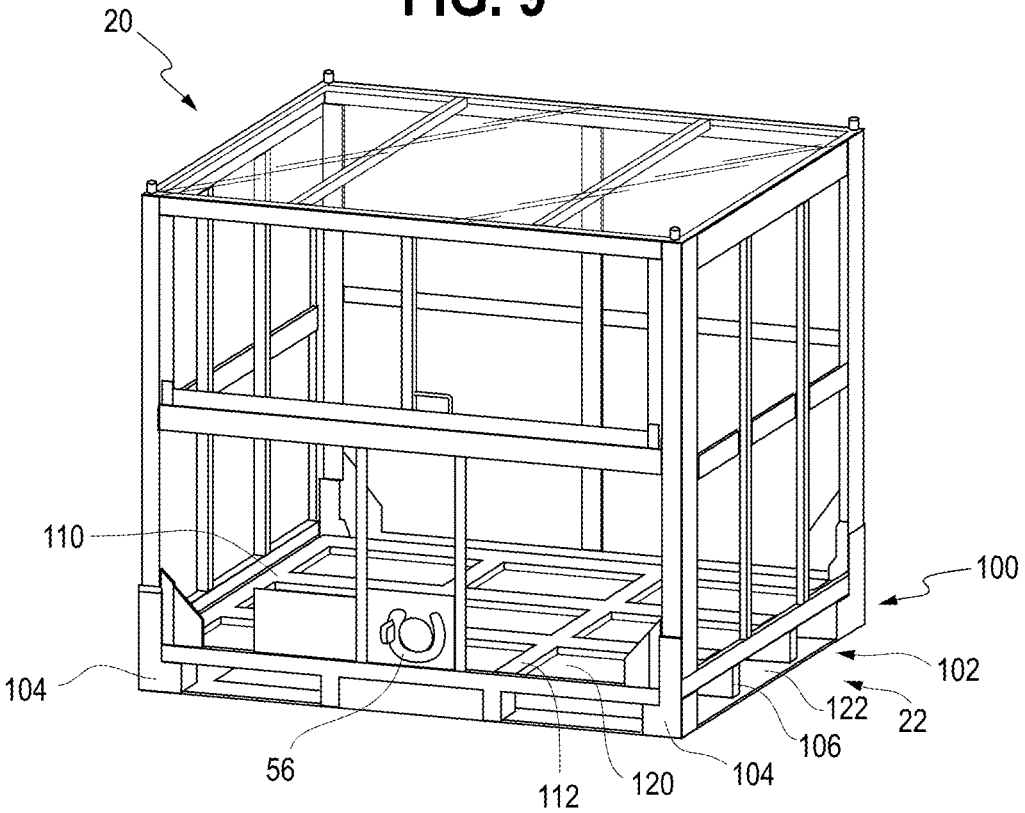
FIG. 9 is a perspective view of the second embodiment in an erected configuration.

FIGS. 8 and 9 illustrate the primary structural members of a second embodiment that is substantially similar to the first embodiment, except that it includes an adapter 56 to facilitate use of the container in connection with transportation of liquids such as tomato paste, with a bag, liner or bladder (not shown) fitting within the container to hold the liquid cargo. In the embodiment of FIGS. 8 and 9, the adapter 56 is provided at or near the bottom of one of the side walls to receive a discharge spout from the bag. The discharge spout may flexible. The adapter defines an opening through which the discharge spout may be pulled, and may include an interior locking structure that engages exterior structure on the spout to lock the spout in an extended discharge position. This facilitates discharge of liquid cargo by gravity, with the bag collapsing as the liquid cargo flows out of the bag through the discharge spout.

Figure 2:
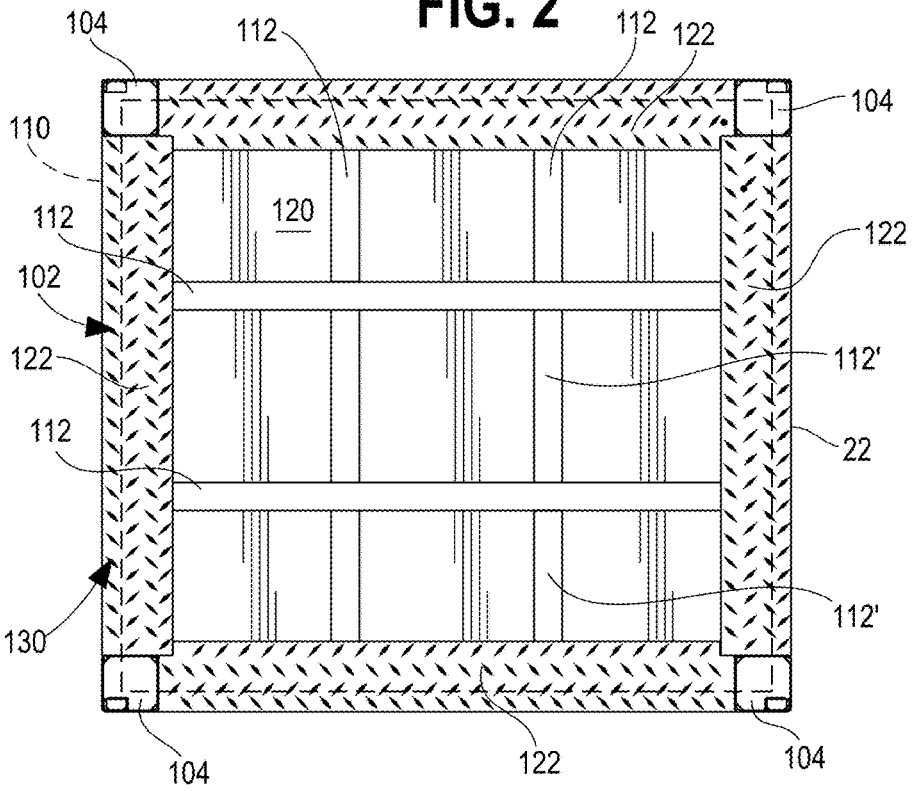
FIG. 2 is a bottom view thereof.
Figure 3:
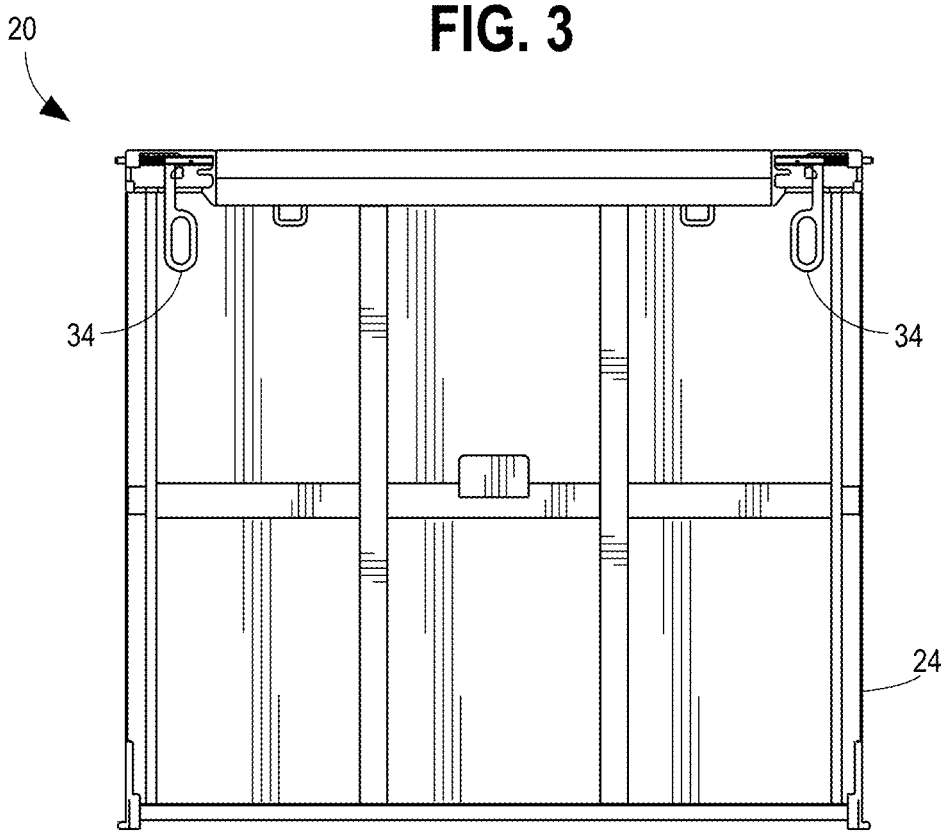
FIG. 3 is an elevational view of the front wall thereof.
Figure 4:
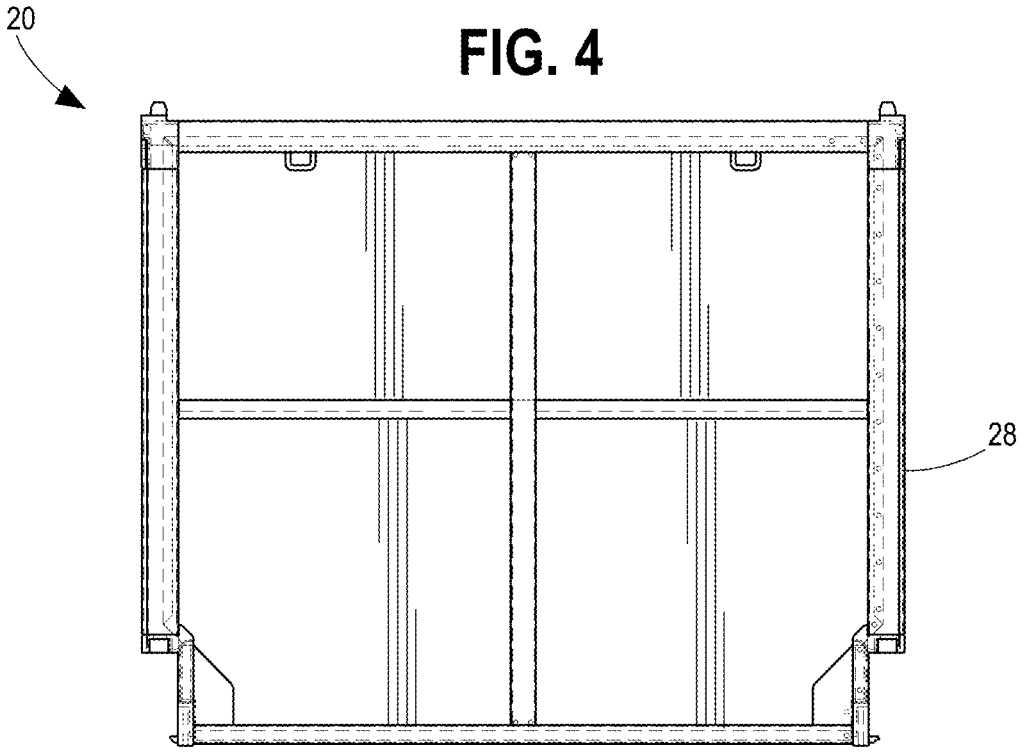
FIG. 4 is an elevational view of a side wall thereof.
Figure 5:
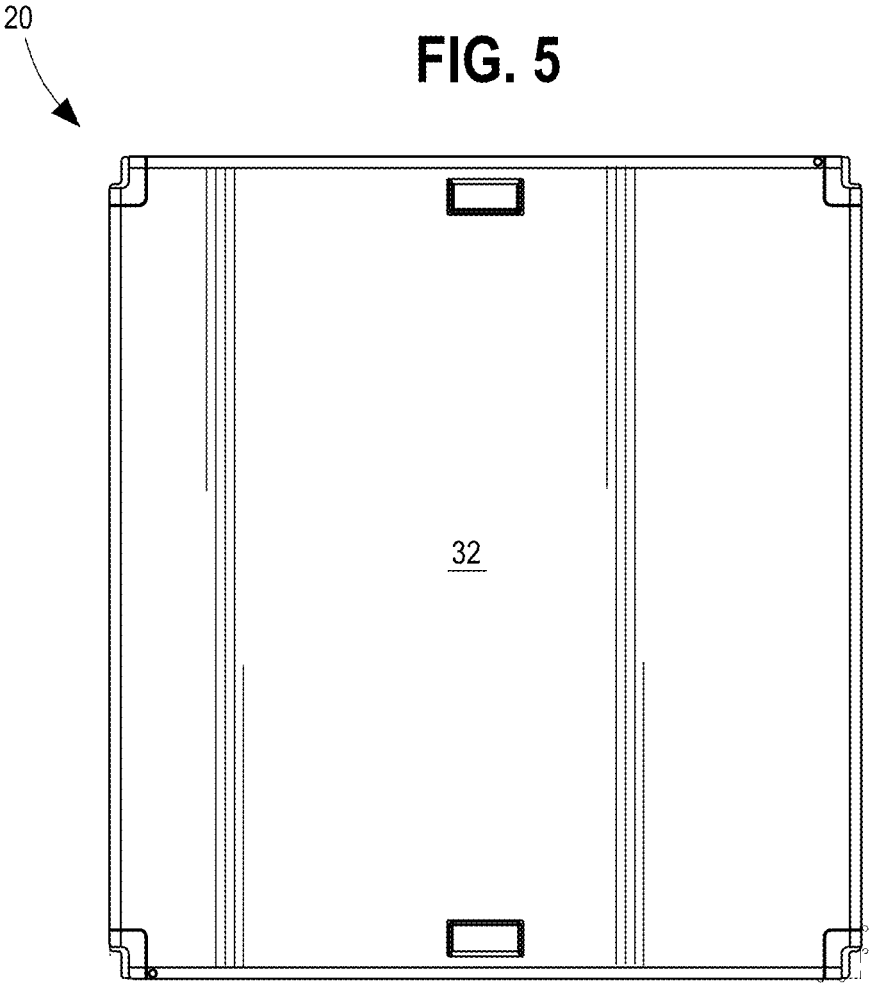
FIG. 5 is a plan view of the top wall thereof.

As shown in FIGS. 1, 2 and 9, the base 22 includes an upper frame 100 and a lower frame 102 that is spaced apart from the upper frame 100. The upper and lower frames 100, 102 may be secured to one or more vertical supports that extend between upper and lower frames 100, 102. The vertical supports may include corner supports 104 and intermediate supports 106 that are disposed between the corner supports 104. The upper and lower frames 100, 102 may be secured to the intermediate supports 106 and the corner supports 104 such that the upper frame 100 is spaced approximately 60 millimeters from the lower frame 102. In this way, the base 22 may receive forklift tines between the upper and lower frames 100, 102.

The upper frame 100 includes upper peripheral frame members 110 that extend about an outer periphery of the base 22, and one or more slats 112 that extend between opposing upper peripheral frames 110. End portions of the upper peripheral frame members 110 may be secured (e.g., welded) to the corner supports 104, and intermediate portions of the upper peripheral frame members 110 may be secured to the intermediate supports 106. In one approach, the slats 112 may be aligned with the intermediate supports 106. End portions of the slats 112 may be secured to the upper peripheral frames 110, to intermediate supports 106, or to both the upper peripheral frames 110 and intermediate supports 106.

In one approach, a slat 112 may be a continuous slat that extends from one peripheral frame 110 to an opposing peripheral frame member 110. In another approach, a slat 112 may be a discontinuous slat that may be formed of a plurality of slat segments 112'. The slat segments 112' may be secured to an intersecting slat 112.

The slats 112 may be arranged in an overlapping or intersecting arrangement. For example, a first set of parallel slats 112 may overlap or intersect a second set of parallel slats 112 at an angle. In the approach shown, two parallel slats 112 intersect two perpendicularly-oriented parallel slats 112.

In this way, the upper peripheral frame members 110 and slats 112 of the upper frame 100 cooperate to form a matrix. In the approach shown, the upper frame 100 defines a 3×3 matrix.

A floor 120 extends above and is at least partially supported by the upper frame 100. The floor 120 may comprise, for example, one or more galvanized steel floor plates. The upper frame 100 and floor 120 cooperate to support the contents of the container 20.

The lower frame 102 of the base 22 includes one or more bottom plates 122 that are vertically spaced from the upper peripheral frames 110 and slats 112. In one approach, the lower frame 102 includes four bottom plates 122 that are arranged end-to-end about an outer periphery of the base 22. End portions of the bottom plates 122 may be secured to corner supports 104 and/or to an adjacent bottom plate 122. The bottom plates 122 may be generally equal in length such that the plates 122 cooperate with the corner supports 104 to form a generally square base 22. In another approach, one pair of parallel bottom plates 122 have a length that is different than orthogonal bottom plates 122 such that the bottom plates 122 form a non-square, generally rectangular base. In still another approach, the lower frame includes a single bottom plate (e.g., a square or rectangular plate) that extends about the entire periphery of the base.

As shown in FIG. 2, the bottom plates 122 may include means to facilitate positive engagement with a conveyor, i.e., to increase lateral drive force that may be applied by engagement between the bottom of the container and a conveyor. This may comprise, e.g., a textured pattern, indicated generally at 130, on a bottom surface of the bottom plates 122. The textured pattern 130 may be, for example, a pattern of anti-skid features that protrude downward from the bottom plates 122. The pattern may be a checker pattern, diamond pattern, or other suitable pattern, and may provide anti-skid properties to the container 20. In one example, each bottom plate 122 is formed of a checker plate, which may also be referred to as a diamond plate or tread plate. In this way, the textured pattern 120 may reduce slippage of the container 20 as the container 20 is transported on a conveyor, e.g., over rolling transport surfaces such as metal rollers. In one approach, bottom surfaces of the corner supports 104 are free of raised anti-skid features. In another approach, bottom surfaces of the corner supports 104 include raised anti-skid features.

Figure 10:
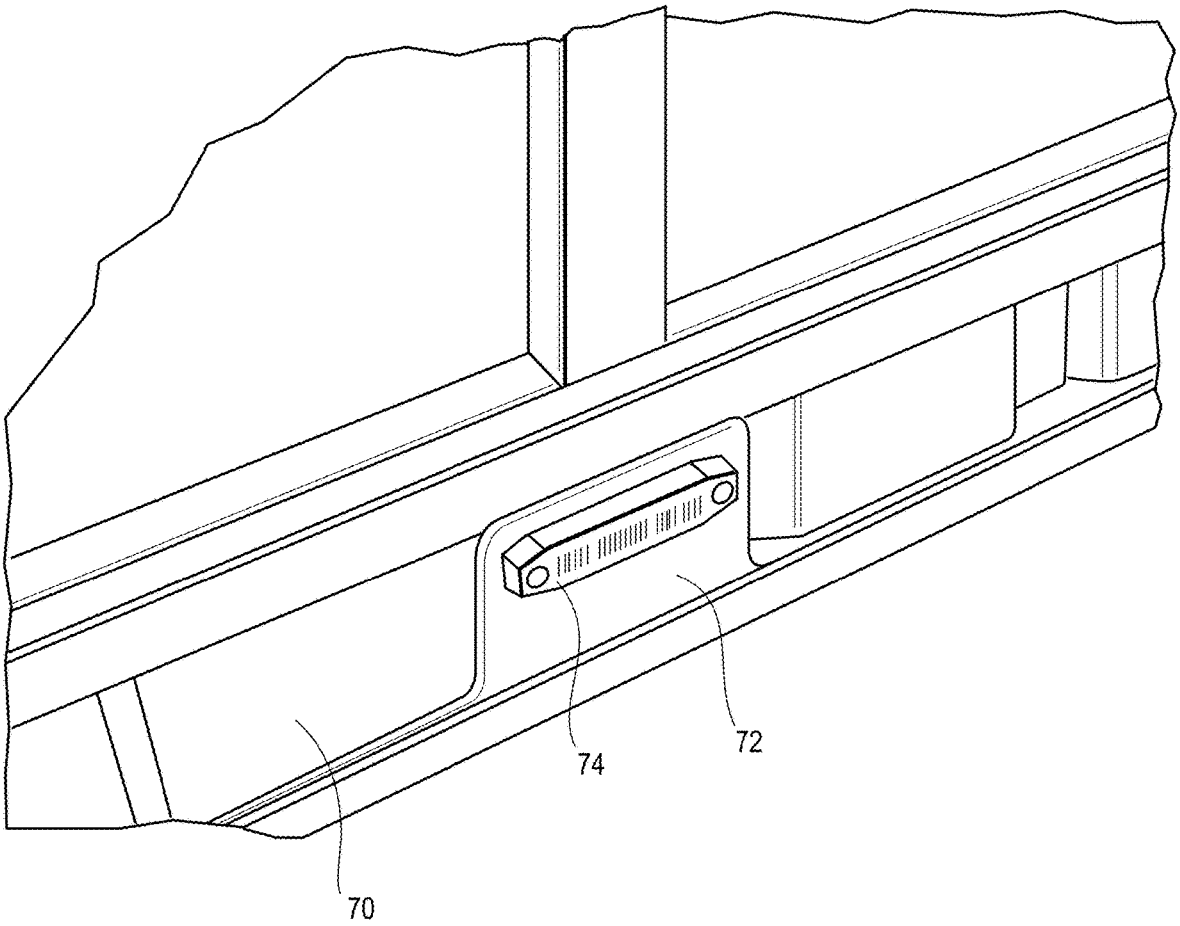
FIG. 10 is a perspective view of an identification module in a recess on a container base.

The base has a side surface 70 with an identification module 74 (shown in FIG. 10) comprising a protective case enclosing an RFID tag disposed in a recess 72 thereon. A bar code, QR code, and/or other identifying information may be provided on an exterior vertical surface of the identification module, with the vertical surface being protected from contact with other containers, fork lift tines, and other objects by being inwardly offset from the front surface 70 of the base in the recess 72. This positioning offers protection from damage due to contact between cargo units, contact with forklift tines, contact with workers' shoes, and other potential sources of damage. The recess may have a maximum horizontal dimension of less than 170 mm, e.g., 100 to 150 mm, or about 125 mm, and a vertical dimension which is smaller than the horizontal dimension, and which may be, e.g., about 50 to 75 mm, or 60 to 65 mm.

The recess 72 may be defined at least in part by outwardly diverging surfaces to facilitate visual/optical access and other access to the exterior vertical surface of the identification module. The recess may be generally rectangular, and may comprise a trapezoidal top and bottom surfaces, and rectangular vertical side surfaces that are angled inward from the exterior front surface of the base.

The containers described herein may be substantially symmetrical such that the front and rear walls are identical, the side walls are identical, and the front and rear of the base are identical, and the opposite sides of the base are identical.

It is contemplated that the containers described herein may be adapted for high-speed, high-volume commercial production.

The method steps described herein can be performed in any suitable order unless otherwise indicated herein or otherwise clearly contradicted by context. The use of any and all examples, or language describing an example (e.g., "such as") provided herein, is intended to illuminate and does not pose a limitation. Any statement herein as to the nature or benefits of embodiments is not intended to be limiting. Any combination of the above-described elements in all possible variations thereof is contemplated unless otherwise indicated herein or otherwise clearly contradicted by context.

What is claimed is:

1. A collapsible container having an erected and a collapsed condition for transporting goods in the erected condition, the container comprising:

a base;

a front wall and a rear wall pivotably attached to the base; and side walls pivotably attached to the base, the side walls positionable between the front and rear walls when the container is in its erected condition;

wherein the base includes an upper frame and a lower frame that is spaced apart from the upper frame to receive forklift tines therebetween, and wherein the lower frame comprises a checker plate having a bottom surface that includes a pattern of anti-skid features and the bottom surfaces of corner supports that extend between the upper frame and lower frame are free of anti-skid features and include openings to permit stacking in the erected configuration;

wherein each of the front and rear walls has a pair of locking mechanisms mounted adjacent opposite sides of its upper end to facilitate securing and releasing a front wall when the container is in its erected position;

each locking mechanism including (a) a locking pin that is longitudinally movable between a closed position in which it extends into an opening in an associated adjacent side wall, and an open position in which it does not extend into the opening, (b) a handle rigidly joined to the locking pin, (c) a spring that urges the locking pin away from its associated adjacent side wall, and (d) a fixed stop that prevents inadvertent unlocking due to vibration;

wherein, when locked, the pin is prevented from rotating and is constrained against lateral displacement by the handle engaging the stop;

wherein, to open the locking mechanisms, the handle must first be displaced laterally toward the adjacent side wall into which its associated locking pin extends, against the urging of the spring, then rotated outward, away from the exterior surface of its associated front or rear wall, thereby disengaging the handle from the stop, then displaced laterally away from the associated adjacent side wall to remove the locking pin from engagement therewith; and wherein the fixed stop is generally J-shaped or L-shaped.

2. The collapsible container of claim 1 wherein the lower frame comprises a plurality of checker plates.

3. The collapsible container of claim 1 wherein the lower frame includes a square arrangement of checker plates.

4. The collapsible container of claim 1 wherein the lower frame includes checker plates arranged end-to-end about an outer perimeter of the base.

5. The collapsible container of claim 4 wherein end portions of the checker plates are secured to the corner supports that extend between the upper frame and lower frame.

6. The collapsible container of claim 5 wherein the end portions of the checker plates include an overlapping portion positioned adjacent the openings to permit stacking in the erected configuration.

7. The collapsible container of claim 1 wherein the locking mechanism further comprises a spacer that provides space between the handle and an adjacent wall surface to facilitate insertion of a digit between the handle and the adjacent wall surface to initiate unlocking.

8. The collapsible container of claim 1 wherein unlocking can be accomplished manually using only one hand.

9. The collapsible container of claim 1 further comprising:

an impermeable inner container fitting within the front, rear and side walls to hold liquid cargo, the impermeable inner container including a discharge spout; and an adapter provided at or near the bottom of one of the front, rear or side walls to receive the discharge spout from the inner container;

wherein the adapter defines an opening through which the discharge spout may be pulled, and includes an interior locking structure that locks the spout in an extended discharge position to facilitate discharge of liquid cargo by gravity, with the inner container collapsing as the liquid cargo flows out of the inner container through the discharge spout.

10. A collapsible container having an erected and a collapsed condition for transporting goods in the erected condition, the container comprising:

a base;

a front wall and a rear wall pivotably attached to the base; and side walls pivotably attached to the base, the side walls positionable between the front and rear walls when the container is in its erected condition;

wherein the base includes an upper frame and a lower frame that is spaced apart from the upper frame to receive forklift tines therebetween, and wherein the lower frame comprises a checker plate having a bottom surface that includes a pattern of anti-skid features and the bottom surfaces of corner supports that extend between the upper frame and lower frame are free of anti-skid features and include openings to permit stacking in the erected configuration;

wherein each of the front and rear walls has a pair of locking mechanisms mounted adjacent opposite sides of its upper end to facilitate securing and releasing a front wall when the container is in its erected position;

each locking mechanism including (a) a locking pin that is longitudinally movable between a closed position in which it extends into an opening in an associated adjacent side wall, and an open position in which it does not extend into the opening, (b) a handle rigidly joined to the locking pin, (c) a spring that urges the locking pin away from its associated adjacent side wall, and (d) a fixed stop that prevents inadvertent unlocking due to vibration;

wherein, when locked, the pin is prevented from rotating and is constrained against lateral displacement by the handle engaging the stop;

wherein, to open the locking mechanisms, the handle must first be displaced laterally toward the adjacent side wall into which its associated locking pin extends, against the urging of the spring, then rotated outward, away from the exterior surface of its associated front or rea wall, thereby disengaging the handle from the stop, then displaced laterally away from the associated adjacent side wall to remove the locking pin from engagement therewith; and wherein fixed stop includes a first portion that extends outward from the front or rear wall and a second portion that extends transversely therefrom.

11. A collapsible container having an erected and a collapsed condition for transporting goods in the erected condition, the container comprising:

a base;

a front wall and a rear wall pivotably attached to the base; and side walls pivotably attached to the base, the side walls positionable between the front and rear walls when the container is in its erected condition;

wherein the base includes an upper frame and a lower frame that is spaced apart from the upper frame to receive forklift tines therebetween, wherein each of the front and rear walls has a pair of locking mechanisms mounted adjacent opposite sides of its upper end to facilitate securing and releasing the front and rear walls when the container is in its erected position;

each locking mechanism including (a) a locking pin that is longitudinally movable between a closed position in which it extends into an opening in an associated adjacent side wall, and an open position in which it does not extend into the opening, (b) a handle rigidly joined to the locking pin, (c) a spring that urges the locking pin away from its associated adjacent side wall, and (d) a fixed stop that prevents inadvertent unlocking due to vibration;

wherein, when locked, the pin is prevented from rotating and is constrained against lateral displacement by the handle engaging the stop;

wherein, to open the locking mechanisms, the handle must first be displaced laterally toward the adjacent side wall into which its associated locking pin extends, against the urging of the spring, then rotated outward, away from the exterior surface of its associated front or rear wall, thereby disengaging the handle from the stop, then displaced laterally away from the associated adjacent side wall to remove the locking pin from engagement therewith, wherein the fixed stop includes a first portion that extends outward from the front or rear wall and a second portion that extends transversely therefrom.

12. The collapsible container of claim 11 wherein the locking mechanism further comprises a spacer that provides space between the handle and an adjacent wall surface to facilitate insertion of a digit between the handle and the adjacent wall surface to initiate unlocking.

13. The collapsible container of claim 11 further comprising an impermeable inner container fitting within the front, rear and side walls to hold liquid cargo, the impermeable inner container including a discharge spout; and an adapter provided at or near the bottom of one of the front, rear or side walls to receive the discharge spout from the inner container;

wherein the adapter defines an opening through which the discharge spout may be pulled, and includes an interior locking structure that locks the spout in an extended discharge position to facilitate discharge of liquid cargo by gravity, with the inner container collapsing as the liquid cargo flows out of the inner container through the discharge spout.

14. The collapsible container of claim 11 wherein the fixed stop is generally J-shaped or L-shaped.

* * * * *